US006361140B1

(12) United States Patent
Ishimatsu et al.

(10) Patent No.: US 6,361,140 B1
(45) Date of Patent: Mar. 26, 2002

(54) LIQUID EJECTING RECORDING HEAD HAVING TWO SUBSTRATES JOINED TOGETHER

(75) Inventors: Shin Ishimatsu; Masanori Takenouchi, both of Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/421,885

(22) Filed: Oct. 21, 1999

(30) Foreign Application Priority Data

Oct. 27, 1998 (JP) ..... 10-321564

(51) Int. Cl.[7] ..... B41J 2/015; B41J 2/05
(52) U.S. Cl. ..... 347/20; 347/65
(58) Field of Search ..... 347/20, 42, 47, 347/44, 65, 63, 45, 67

(56) References Cited

U.S. PATENT DOCUMENTS

| | | | | |
|---|---|---|---|---|
| 5,748,213 A | | 5/1998 | Karita et al. | 347/63 |
| 5,774,149 A | * | 6/1998 | Shimizu | 347/63 |
| 5,784,079 A | * | 7/1998 | Masuda et al. | 347/20 |
| 5,808,641 A | | 9/1998 | Miyagawa et al. | 347/65 |
| 6,155,677 A | | 12/2000 | Kitani et al. | 347/65 |
| 6,220,688 B1 | | 4/2001 | Ishimatsu et al. | 347/20 |

FOREIGN PATENT DOCUMENTS

| | | | |
|---|---|---|---|
| EP | 0 578 329 A1 | 1/1994 | B41J/2/14 |
| EP | 0 656 261 A2 | 6/1995 | B41J/2/14 |
| EP | 0 756 934 A2 | 2/1997 | B41J/2/16 |
| EP | 0 847 860 A2 | 6/1998 | B41J/2/16 |
| JP | 55-132253 | 10/1980 | B41J/3/04 |
| JP | 2-192954 | 7/1990 | B41J/2/175 |
| JP | 4-171128 | 6/1992 | B23P/21/00 |
| JP | 7-148926 | 6/1995 | B41J/2/05 |
| JP | 7-148944 | 6/1995 | B41J/2/21 |

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

A liquid injecting recording head is constructed by a first substrate in which a discharging energy generating element for generating discharging energy for discharging a recording liquid is formed, and a second substrate which has a liquid flow path groove forming a liquid flow path by joining this liquid flow path groove to the first substrate, a concave portion communicated with the liquid flow path groove and forming a common liquid chamber for temporarily holding the recording liquid, and an orifice plate communicated with the liquid flow path groove and having a discharging port for discharging the recording liquid. The liquid injecting recording head is constructed by joining the first and second substrates to each other in a form in which the discharging energy generating element and the liquid flow path groove correspond to each other. The liquid injecting recording head is characterized in that both end portions of a face opposed to a face of the second substrate joined to the first substrate are formed to be thin.

21 Claims, 7 Drawing Sheets

LIQUID EJECTING RECORDING HEAD HAVING TWO SUBSTRATES JOINED TOGETHER

BACKGROUND OF THE INVENTION

1. Field of the Invention

The present invention relates to a liquid ejecting recording head for performing a recording operation by discharging a recording liquid from a small discharging port as a liquid droplet and attaching this recording liquid to a recorded medium such as recording paper, etc. in a liquid ejecting recording system, and particularly, relates to a liquid ejecting recording head capable of stably discharging the recording liquid droplet at high speed to form a high definition image.

2. Related Background Art

As described in Japanese Patent Application Laid-Open No. 55-132253, a conventional general liquid ejecting recording head is constructed by joining first and second substrates to each other. A discharging energy generating element for discharging a recording liquid is formed in the first substrate. The second substrate has a discharging port for discharging the recording liquid, a liquid flow path groove communicated with the discharging port, and a common liquid chamber for supplying the recording liquid to this liquid flow path groove. The first and second substrates are joined to each other in a form in which the discharging energy generating element and the flow path groove correspond to each other.

Japanese Patent Application Laid-Open No. 2-192954 discloses a liquid ejecting recording head having first and second substrates. A discharging energy generating element is formed in the first substrate. A common liquid chamber and plural liquid flow path grooves having an opening portion as a discharging port from this common liquid chamber are formed in the second substrate. The first and second substrates are more reliably joined to each other by a mechanical biasing force.

Further, in a method introduced in Japanese Patent Application Laid-Open No. 4-171128, a position of the discharging energy generating element of the first substrate and a position of the discharging port of the second substrate are respectively measured to accurately join the first and second substrates. Measured values of these positions are compared with each other, and the second and first substrates are relatively moved by a difference between these measured values so that the positions of the discharging energy generating element and the discharging port are aligned with each other.

Further, Japanese Patent Application Laid-Open Nos. 7-148944 and 7-148926, etc. propose a compact liquid ejecting recording head for color. In this liquid ejecting recording head for color, a second substrate has a discharging port for discharging a recording liquid, a liquid flow path groove communicated with the discharging port, and a common liquid chamber for supplying the recording liquid to this liquid flow path groove. In this second substrate, the common liquid chamber is divided into plural chambers and a recording liquid of a different color is supplied for each of the plural chambers.

FIG. 7 is an exploded perspective view showing the construction of the conventional general liquid ejecting recording head. In this figure, reference numeral 111 designates a first substrate in which a discharging energy generating element 111*a* is formed. This first substrate 111 is fixed to a base plate 112 together with a wiring substrate 113 for transmitting an electric signal. A second substrate 114 has plural concave portions for constructing plural common liquid chambers, plural liquid flow path grooves, and plural discharging ports 114*a* for discharging a recording liquid. A pressing member 115 such as a spring, etc. presses against the first substrate 111 and is joined to this first substrate 111 by giving a mechanical biasing force to the second substrate 114.

Positions of both the substrates are aligned with each other and these substrates are joined to each other such that the discharging energy generating element 111*a* of the first substrate 111 and the discharging ports 114*a* and the liquid flow path grooves of the second substrate 114 correspond to each other. The biasing pressing force of the pressing member 115 is given to an upper face of the second substrate 114, particularly, to an upper portion of a forming portion of the liquid flow path grooves of the second substrate 114 so that joining faces of the first and second substrates 111, 114 are closely attached to each other.

In the liquid ejecting recording head, the second substrate is large-sized to obtain a higher definition image for a short time when the number of liquid flow paths, i.e., the number of nozzles, is increased. As a result, the joining of the first and second substrates becomes insufficient so that it is very difficult to obtain an adequate image. As a general countermeasure for coping with such a situation, there is a method for increasing a resilient pressure of the spring member as the mechanical biasing force. However, in this method, this pressure is too strong and pressure concentration is caused so that the second substrate is excessively deformed. Further, this deformation is also transmitted to an orifice plate and causes deformation of the discharging ports, etc. When such deformation of the discharging ports is caused, the reaching position of a recording liquid droplet is shifted so that no sufficient image can be instantly obtained.

When no sufficient joining of the first and second substrates is obtained, a gap is caused between the first substrate and each liquid flow path groove of the second substrate. Therefore, pressure generated by the discharging energy generating element is dissipated by this gap so that the discharge of the recording liquid becomes unstable. Further, in the liquid ejecting recording head for color, an excessive gap is also formed between the first substrate and a common liquid chamber separating wall for separating the common liquid chambers from each other. Therefore, the separation wall of the common liquid chambers becomes insufficient so that the recording liquids of the common liquid chambers are mixed with each other in a worst case.

The reaching position of the liquid droplet is also shifted by slight warping of the second substrate and slight bending of a joining face of the second substrate to the first substrate, etc. caused as the second substrate is large-sized. In particular, when the second substrate is manufactured by injection molding, an important matter is to restrain this slight warping and bending.

Simultaneously, it is gradually required to accurately align the position of a center of the discharging energy generating element of the first substrate and the position of a center of the liquid flow path groove of the second substrate. When these centers are not in conformity with each other, the discharge of the recording liquid is unbalanced and this unbalance has an influence on the reaching position of the liquid droplet. In particular, foaming is unbalanced when the discharging energy generating element is a heating element such as an electricity heat converting element, etc.

SUMMARY OF THE INVENTION

In view of the unsolved problems of the above prior art, an object of the present invention is to provide a liquid ejecting recording head in which first and second substrates can be closely joined to each other easily and reliably at low cost and a high definition image can be obtained at high speed.

To achieve the above object, the present invention resides in a liquid ejecting recording head comprising a first substrate in which a discharging energy generating element for generating discharging energy for discharging a recording liquid is formed, a second substrate which has a liquid flow path groove which forms a liquid flow path by joining the liquid flow path groove to the first substrate, a concave portion communicating with the liquid flow path groove and forming a common liquid chamber for temporarily holding the recording liquid, and an orifice plate communicating with the liquid flow path groove and having a discharging port for discharging the recording liquid wherein the liquid ejecting recording head is constructed by joining the first and second substrates to each other in a manner such that the discharging energy generating element and the liquid flow path groove correspond to each other, and both end portions of a pressed face of the second substrate, opposed to a joining face of the second substrate joined to the first substrate, are formed to be thin.

The present invention also resides in a liquid ejecting recording head comprising a first substrate in which a discharging energy generating element for generating discharging energy for discharging a recording liquid is formed, a second substrate which has a liquid flow path groove which forms a liquid flow path by joining the liquid flow path groove to the first substrate, a concave portion communicating with the liquid flow path groove and forming a common liquid chamber for temporarily holding the recording liquid, and an orifice plate communicating with the liquid flow path groove and having a discharging port for discharging the recording liquid wherein the liquid ejecting recording head is constructed by joining the first and second substrates to each other in a manner such that the discharging energy generating element and the liquid flow path groove correspond to each other, and digging-in concave portions are formed in both end portions of a pressed face of the second substrate opposed to a joining face of the second substrate joined to the first substrate.

The present invention also resides in a liquid ejecting recording head comprising a first substrate in which a discharging energy generating element for generating discharging energy for discharging a recording liquid is formed, a second substrate which has a liquid flow path groove which forms a liquid flow path by joining the liquid flow path groove to the first substrate, a concave portion communicating with the liquid flow path groove and forming a common liquid chamber for temporarily holding the recording liquid, and an orifice plate communicating with the liquid flow path groove and having a discharging port for discharging the recording liquid, wherein the liquid ejecting recording head is constructed by joining the first and second substrates to each other in a manner such that the discharging energy generating element and the liquid flow path groove correspond to each other, and a length A of the second substrate in an arranging direction of the liquid flow path groove on a joining face of the second substrate joined to the first substrate is longer than a length B of the first substrate, and is also longer than an arranging length C of the discharging port, and these lengths satisfy the relation of $(A-C)/2 \geqq 1.1$ mm and $(B-C)/2 \geqq 0.825$ mm.

The present invention further resides in a liquid ejecting recording head comprising a first substrate in which a discharging energy generating element for generating discharging energy for discharging a recording liquid is formed, a second substrate which has a liquid flow path groove which forms a liquid flow path by joining the liquid flow path groove to the first substrate, a concave portion communicating with the liquid flow path groove and forming a common liquid chamber for temporarily holding the recording liquid, and an orifice plate communicating with the liquid flow path groove and having a discharging port for discharging the recording liquid wherein the liquid ejecting recording head is constructed by joining the first and second substrates to each other in a manner such that the discharging energy generating element and the liquid flow path groove correspond to each other, and at least one concave portion is formed on a face of the orifice plate joined to the first substrate.

In the liquid ejecting recording head of the present invention, digging-in concave portions are preferably formed in both the thin end portions of a pressed face of the second substrate opposed to a joining face of the second substrate joined to the first substrate. Further, both the thin end portions of a pressed face of the second substrate opposed to a joining face of the second substrate joined to the first substrate and the digging-in concave portions are preferably arranged with bilateral symmetry with respect to a central line of the second substrate.

In the liquid ejecting recording head of the present invention, the concave portion formed on the face of the orifice plate is preferably arranged in each of positions corresponding to both end faces of the first substrate.

In the liquid ejecting recording head of the present invention, the concave portion in the second substrate which forms the common liquid chamber by joining the concave portion to the first substrate is preferably separated into plural concave portions by a common liquid chamber separating wall. Further, a concave portion groove preferably extends along a liquid discharging direction, in a portion corresponding to the common liquid chamber separating wall for separating the concave portion forming the common liquid chamber into plural concave portions, on a pressed face of the second substrate opposed to a joining face of the second substrate joined to the first substrate. The concave portion groove can be formed in a trapezoidal shape in cross section.

In accordance with the present invention, warping of the second substrate constituting the liquid ejecting recording head can be reduced. Further, the second substrate is easily deformed and a close attaching property of the second and first substrates can be improved. Thus, the discharging amount and speed of the recording liquid of the liquid ejecting recording head are stabilized. As a result, the reaching accuracy of a recording liquid droplet is improved and a high definition image can be obtained at high speed.

Both end portions of the second substrate on a pressed face of the second substrate opposed to a joining face of the second substrate joined to the first substrate are formed to be thin. Also, a digging-in concave portion is formed in each of the end portions on a pressed face of the second substrate opposed to a joining face of the second substrate joined to the first substrate. Further, a digging-in concave portion is formed in each of the thin wall portions of the end portions. Thus, warping of the second substrate can be reduced and a joining close attaching property can be improved. Further, the molding stability at a molding time of the second substrate can be improved.

Further, a length A of the second substrate in an arranging direction of the liquid flow path groove on a joining face of the second substrate joined to the first substrate is set to be longer than a length B of the first substrate, and is also set to be longer than an arranging length C of the discharging port and these lengths are set to satisfy the relation of $(A-C)/2 \geqq 1.1$ mm and $(B-C)/2 \geqq 0.825$ mm. Accordingly, a position of the discharging port for discharging the recording liquid can be separated from the position of a joining start point at which an end portion of the first substrate, as a portion in which stress is concentrated most strongly in pressing and joining of the second substrate to the first substrate, is joined to the second substrate. Therefore, if stress is concentrated, the discharging port is sufficiently separated from this concentrated stress portion that no liquid discharge from the discharging port is influenced by this stress concentration. As a result, when the second substrate and the first substrate are joined to each other by giving a mechanical biasing force, the amount of this biasing force can be increased.

In the orifice plate of the second substrate, at least one concave portion is formed in positions corresponding to both end faces of the first substrate. Accordingly, it is possible to reduce the stress concentration caused when the first and second substrates are joined to each other. Further, deformation of the second substrate can be restrained.

DESCRIPTION OF THE PREFERRED EMBODIMENTS

The embodiments of the present invention will next be described on the basis of the drawings.

(First Embodiment)

Figure 1A:
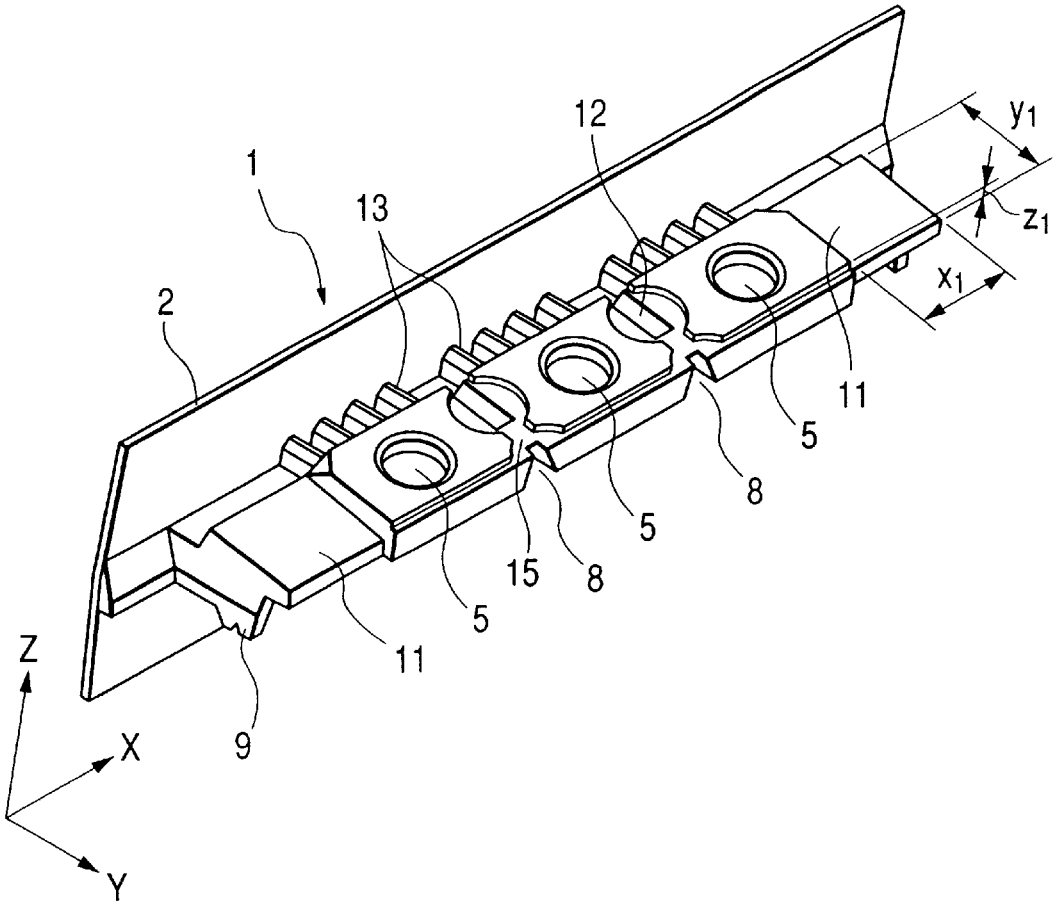
FIG. 1A is a perspective view of a second substrate constituting a liquid ejecting recording head in a first embodiment of the present invention.
Figure 1B:
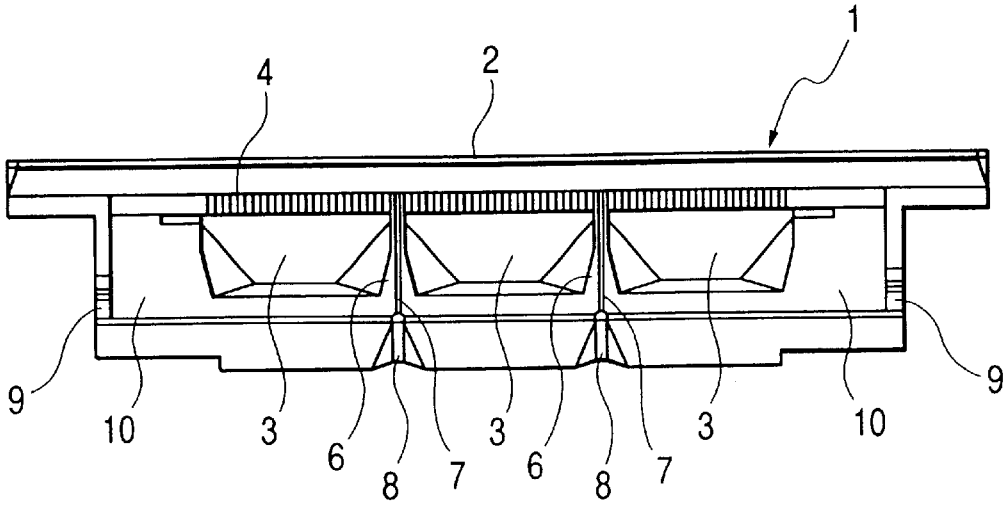
FIG. 1B is a plan view of the second substrate seen from its joining face side on which a liquid flow path groove and a common liquid chamber are formed.

FIG. 1A is a perspective view of a second substrate constituting a liquid ejecting recording head in a first embodiment of the present invention. FIG. 1B is a plan view of this second substrate seen from its joining face side on which a liquid flow path groove and a common liquid chamber are formed.

In FIGS. 1A and 1B, the second substrate 1 constituting the liquid ejecting recording head has an orifice plate 2 forming unillustrated plural discharging ports therein, and plural concave portions (hereafter, simply called common liquid chambers) 3 in which plural common liquid chambers for temporarily holding a recording liquid supplied to the discharging ports are formed. The second substrate 1 also has a liquid flow path groove 4 and a liquid supply port 5. The liquid flow path groove 4 is located in accordance with the position of a discharging energy generating element and is communicated with one of the plural common liquid chambers 3 and is arranged to form a liquid flow path communicated with the discharging ports. The liquid supply port 5 is formed to supply the recording liquid to each of the plural common liquid chambers 3. A common liquid chamber separating groove 7 is formed in a common liquid chamber separating wall 6 arranged to divisionally separate the plural common liquid chambers 3 from each other. The common liquid chamber separating groove 7 separates the common liquid chambers 3 from each other by filling the interior of the common liquid separating groove 7 with a filler. A sealant ejecting port 8 for ejecting a sealant to the common liquid chamber separating groove 7 is formed in an end portion of the common liquid chamber separating groove 7. A temporary stopping leg 9 is arranged in each of both end portions of a joining face (herein, this face is also simply called a joining face) of the second substrate 1 joined to the first substrate such that the second substrate 1 is projected from this joining face. This temporary stopping leg 9 is arranged to stabilize the second substrate 1 when the second substrate 1 is joined to the first substrate. The temporary stopping leg 9 is arranged such that this temporary stopping leg 9 is separated from each of the common liquid chambers 3 at left-hand and right-hand ends of the second substrate 1 through a common liquid chamber frame 10 (see FIG. 1B).

A face opposed to the joining face arranging the plural common liquid chambers 3, the liquid flow path groove 4, the common liquid chamber separating groove 7, etc. thereon is here a face (herein, this face is also simply called a pressing face or a pressed face) pressed by an unillustrated pressing member such as a spring, etc. A thin wall portion 11, a concave portion groove 12 and plural convex portions 13 are formed on the pressing face shown in FIG. 1A. The thin wall portion 11 is set to be thin in a portion corresponding to the common liquid chamber frame 10 in each of both end portions of the second substrate 1. The concave portion groove 12 is arranged in a position of the pressing face corresponding to the common liquid chamber separating wall 6 for divisionally separating the common liquid chambers 3 from each other. The concave portion groove 12 is formed in a trapezoidal shape in cross section, etc. extending along a liquid discharging direction. The plural convex portions 13 are formed in an elongated shape along the liquid discharging direction in a portion corresponding to an arranging position of the liquid flow path groove 4. The plural concave portions 13 are arranged along an arranging direction of the liquid flow path groove 4. The plural concave portions 13 receive pressing force of the pressing member such as a spring, etc. for pressing and joining the second substrate 1 to the first substrate. In this way, warp and deformation of the second substrate 1 or dispersion of the pressing force in the arranging direction of the liquid flow path groove due to deviation in accuracy of the pressing member is dispersed by receiving the pressing force of the pressing member at plural points. An entire range of a liquid flow path area is pressed by the uniform pressing force and a joining property of the liquid flow path area of the second and first substrates is improved. A step difference portion 15 is formed in a corner portion of a peripheral portion of a liquid supply port 5 on the pressing face, a peripheral portion of the concave portion groove 12 or the sealant ejecting port 8, etc. when the second substrate 1 is molded by resin. A slight step difference and an inclination are formed in the step difference portion 15 to restrain generation of burrs, etc. In particular, when a burr is formed around the liquid supply port 5, there is a fear of not being able to record since this burr is mixed into the recording liquid during a recording operation. The step difference portion 15 is arranged to prevent such a situation. An operation of the concave portion groove 12 will be described later.

As mentioned above, in the second substrate of this embodiment, the common liquid chamber frame 10 extends outward from the common liquid chamber 3 located at each of both ends of the plural common liquid chambers 3 in view of resin molding and a joining close attaching property as described later. Namely, the common liquid chamber frame 10 located in each of both side end portions of the second substrate 1 is molded with a certain width to preferably mold the temporary stopping leg 9. In such a second substrate 1, the common liquid chamber 3 is dug into a central portion of the second substrate 1 so that this central portion is set to be thin. However, portions of the common liquid chamber frame 10 located in each of both the side end portions are set to be thick. Ununiformity of the thickness caused in this second substrate 1 causes slight warping and bending at a molding time of the second substrate 1. The warping and the bending of this second substrate 1 are normally compulsorily restrained by a load of the pressing member such as a spring, etc., and the first substrate and the second substrate 1 are joined to each other. However, when the warping and the bending of the second substrate are too large, it is difficult to make both the substrates come into sufficiently close contact with each other.

Therefore, in the second substrate of this embodiment, the thickness of a portion 11 opposed to the common liquid chamber frame 10 in each of both the side end portions of a joining face joined to the first substrate is set to be thin on the pressing face. These thin wall portions 11 in both the side end portions are arranged in a bilateral symmetrical shape with respect to a central line of the second substrate. Concretely, both end portions of the second substrate 1 on its pressing face are cut by about 2.35 mm×1.84 mm×0.4 mm ((x1)×(y1)×(z1) in FIG. 1A) and are set to the thin wall portions 11.

Thus, the thickness of the portion 11 opposed to the common liquid chamber frame 10 in each of both the side end portions on the joining face joined to the first substrate is set to be thin so that warping of the second substrate 1 can be reduced. Further, warping of the second substrate and bending of the second substrate on the joining face to the first substrate can be reduced by arranging the thin wall portions 11 in both the side end portions in the bilateral symmetrical shape with respect to the central line of the second substrate 1. Molding stability is also improved at a molding time of the second substrate.

Further, the common liquid chamber frame 10 extends further outward from each of common liquid chambers 3 located at both ends of the plural common liquid chambers 3. This extending portion is set to be thin and is set to the thin wall portion 11. Accordingly, a liquid discharging functional portion molding the liquid flow path groove and the discharging ports therein is located in a central portion of the liquid flow path groove in its arranging direction on the joining face even when warping and bending are caused on the joining face of the second substrate 1. Therefore, influences of the warping and the bending on the entire joining face are small so that a joining close attaching property of the liquid discharging functional portion can be improved.

When a high definition image of a color type is formed, it is required that a nozzle pitch (total pitch) from one end portion of a nozzle series to the other end portion is correctly in conformity with a liquid reaching position, and nozzle pitches in and of respective colors are also correctly in conformity with each other, respectively.

However, in a conventional construction for forming the plural liquid chambers in one second substrate by molding, there is a case in which warping is caused in a discontinuous angular shape in accordance with shapes of the liquid chambers of the respective colors in a forward-backward direction with respect to a discharging direction after the molding. In this case, it is difficult to make uniform the nozzle pitches of the respective colors. In the present invention, the warping shape can be set to a continuous monotonous angular shape by forming the above concave portion groove 12. The total pitch and the respective color pitches can be corrected by adjusting a laser beam at a time of forming the discharging ports so that the present invention can be applied to a high definition color image. This concave portion groove 12 also has effects of making each of the liquid chambers easily come in close contact with an element substrate in a uniform state.

Figure 7:
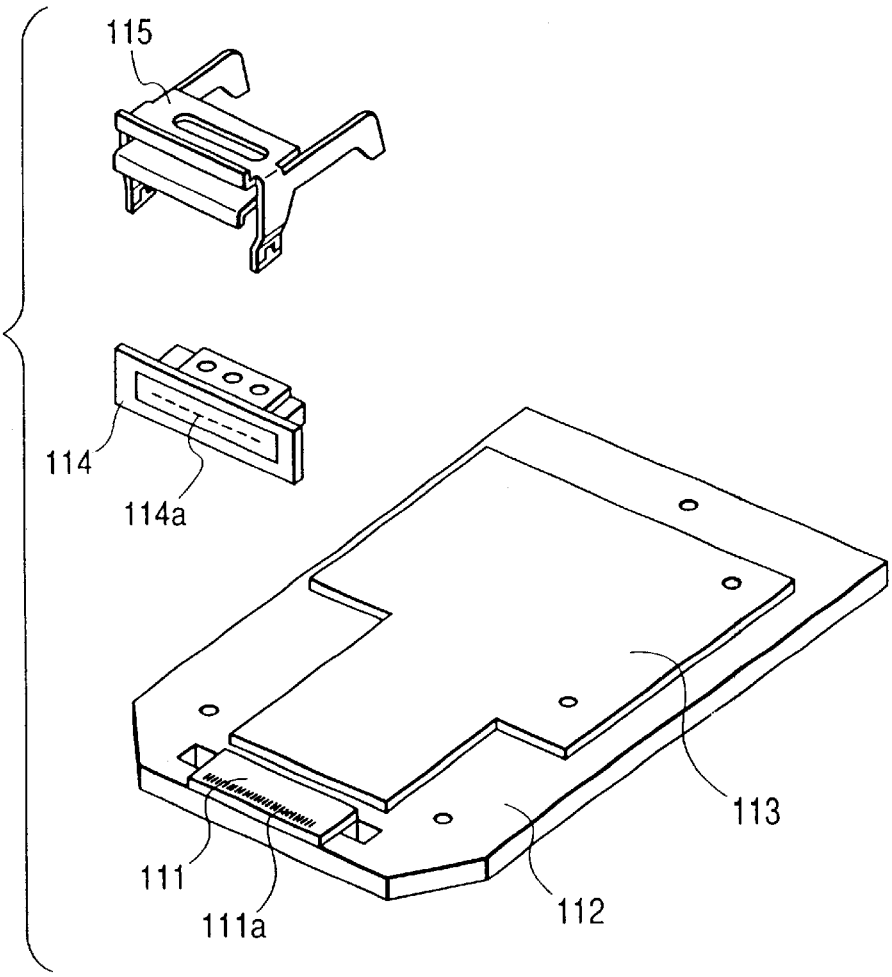
FIG. 7 PRIOR ART
FIG. 7 is an exploded perspective view showing the construction of a conventional general liquid ejecting recording head.

As shown in FIG. 7, the second substrate 1 of this embodiment having such a structure and a second substrate having no thin wall portion 11 are assembled and liquid ejecting recording heads are formed in a state in which a load of the pressing member such as a spring, etc. is set to 25 N. These liquid ejecting recording heads are then compared with each other. In the liquid ejecting recording head using the second substrate 1 having the thin wall portion 11, deviations in discharging amount and speed are small and stable and the reaching accuracy of a liquid droplet is also preferable in comparison with the liquid ejecting recording head in which the second substrate having no thin wall portion is used and assembled.

(Second embodiment)

Figure 2A:
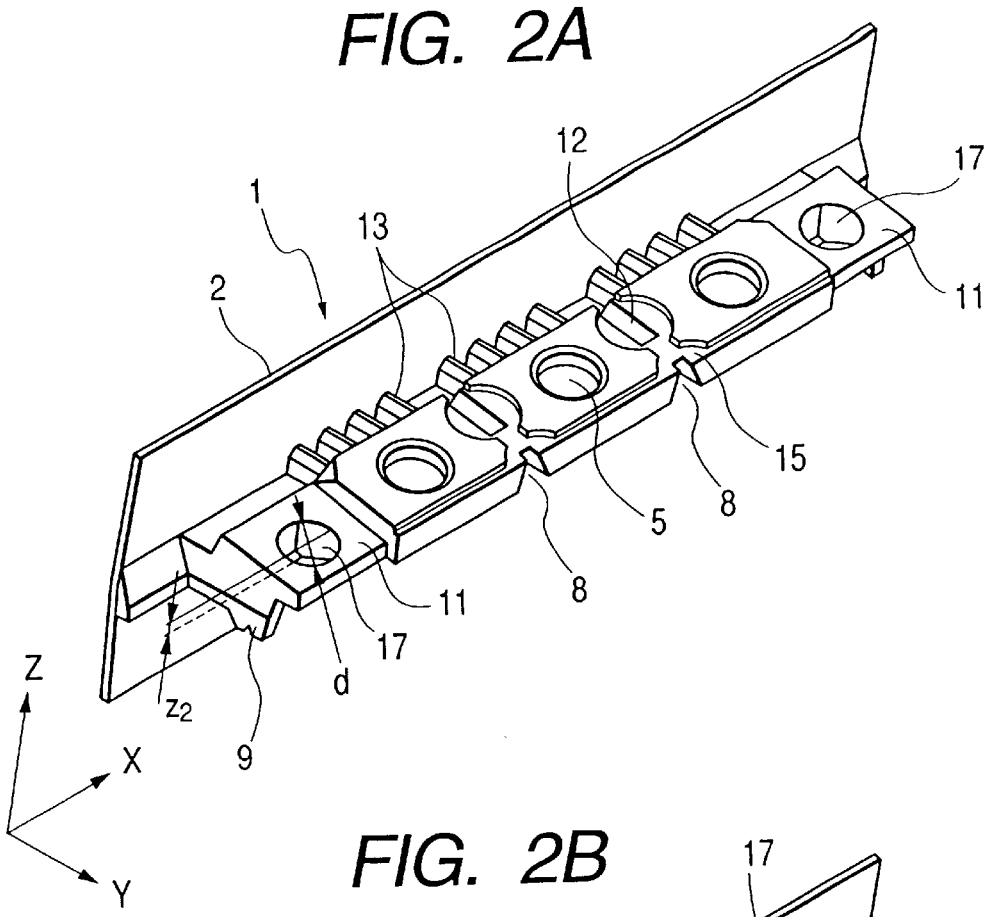
FIGS. 2A and 2B are perspective views of a second substrate constituting a liquid ejecting recording head in a second embodiment of the present invention.
Figure 2B:
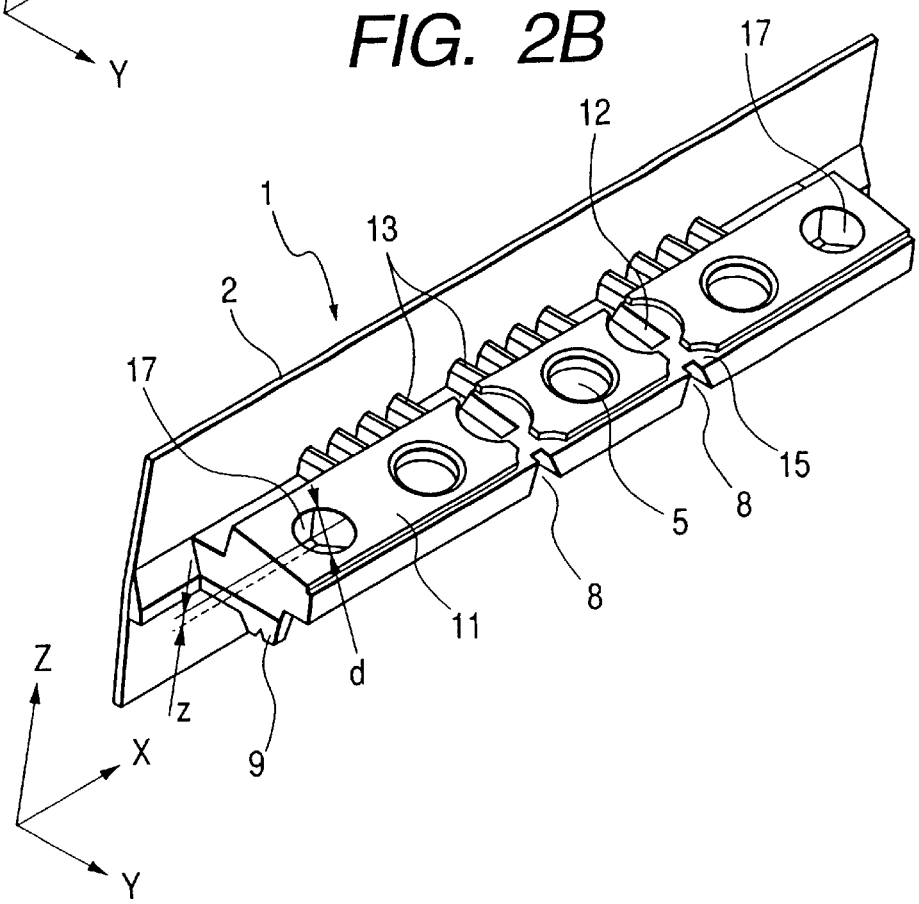

FIGS. 2A and 2B are perspective views of a second substrate constituting a liquid ejecting recording head in a second embodiment of the present invention. Members and portions similar to those in the above first embodiment are designated by the same reference numerals, and a detailed explanation of these members and portions is omitted here.

In FIG. 2A, a thin wall portion 11 is formed in each of both end portions of the pressing face. A digging-in concave portion 17 is dug into the thin wall portion 11. In this embodiment, the digging-in concave portion 17 is approximately formed in a conical shape having 1.03 mm in diameter (d in FIG. 2A) and 0.5 mm in depth (z2 in FIG. 2A) in the thin wall portion 11 of the second substrate 1 in the first embodiment. The other constructions are similar to those in the first embodiment.

When the second substrate having such a construction is molded, warping of the second substrate 1 is small. When this second substrate is assembled as in the first embodiment and the liquid ejecting recording head is formed, deviations in discharging amount and speed are very small and the reaching accuracy of a liquid droplet is almost unchanged in comparison with a case in which no digging-in concave portion 17 is formed.

In this embodiment, a molding property of the second substrate is improved while the deviations in discharging amount and speed are slightly improved and the reaching accuracy of a liquid droplet is almost unchanged in comparison with the first embodiment. A warping amount of the second substrate is small in comparison with the first embodiment. Warping of the liquid flow path groove 4 is 4 $\mu$m in a Y-direction and 7 $\mu$m in a Z-direction in the first embodiment. In contrast to this, the warping is 2 $\mu$m in the Y-direction and 4 $\mu$m in the Z-direction in this embodiment. It is supposed that this is because releasing the mold from a die is easily performed at a time of molding the second substrate and no additional load is applied to the second substrate by molding the digging-in concave portion 17 in the shape of an ejector pin.

In a modified example of the second substrate shown in FIG. 2B, the digging-in concave portion 17 is approximately formed in a conical shape in a portion opposed to the common liquid chamber frame 10 in each of both side end portions of a joining face joined to the first substrate without setting this portion to be thin. Similar to the second substrate shown in FIGS. 1A and 1B and FIG. 2A, warping of the second substrate can be also reduced by forming the digging-in concave portion 17 similarly having a depth (z) and a diameter (d) in each of both the side end portions of the pressing face. Further, releasing the mold from a die is easily performed at the molding time of the second substrate and no additional load is applied to the second substrate by molding the digging-in concave portion 17 in the shape of an ejector pin. Accordingly, a stable molding property can be obtained.

The liquid ejecting recording head is formed by assembling the second substrate 1 having the digging-in concave portion 17. Another liquid ejecting recording head is also formed by assembling the second substrate having no digging-in concave portion. These liquid ejecting recording heads are then compared with each other. In the liquid ejecting recording head formed by assembling the second substrate 1 having the digging-in concave portion 17, deviations in discharging amount and speed are small and stable and the reaching accuracy of a liquid droplet is also preferable in comparison with the other liquid ejecting recording head.

As mentioned above, in the second substrate of this embodiment, the digging-in concave portion is formed in each of both side end portions of the pressing face opposed to the joining face joined to the first substrate. Also, both the side end portions are set to be thin and the digging-in concave portion is formed in each of these thin portions. Thus, warping of the second substrate can be reduced and a mold releasing property from a die at a molding time can be improved. Further, a stabler molding property can be obtained by arranging these digging-in concave portions with bilateral symmetry with respect to a central line of the second substrate.

(Third Embodiment)

Figure 3:
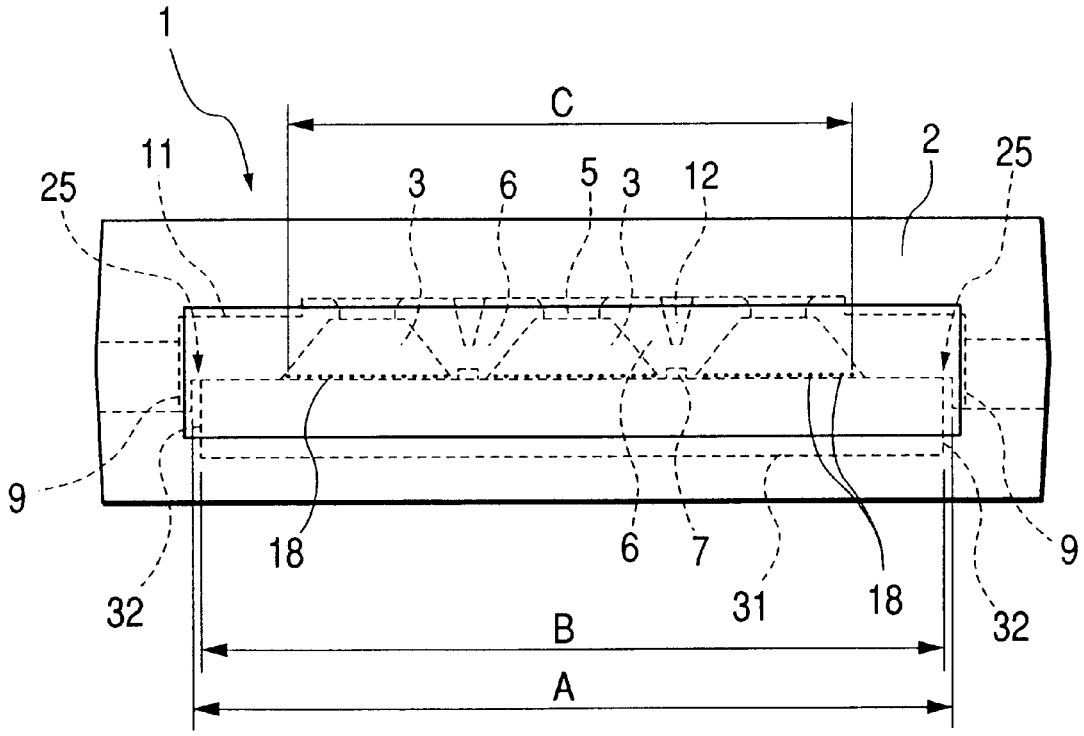
FIG. 3 is a conceptual view seen from a liquid discharging side to show the relation of second and first substrates in a liquid ejecting recording head in a third embodiment of the present invention.

FIG. 3 is a conceptual view seen from a liquid discharging side to show the relation of second and first substrates in a liquid ejecting recording head in a third embodiment of the present invention. In this embodiment, members and portions similar to those in the above embodiments are also designated by the same reference numerals, and a detailed explanation of these members and portions is omitted here.

In FIG. 3, similar to the second substrate of the above first and second embodiments, a second substrate 1 has an orifice plate 2 in which plural discharging ports 18 are formed. Plural liquid flow path grooves 4, plural common liquid chambers 3, and a common liquid chamber separating wall 6 and a common liquid chamber separating groove 7 for divisionally separating the common liquid chambers 3 from each other are formed on a joining face of the second substrate joined to a first substrate 31. Further, a temporary stopping leg 9 is formed in each of both end portions of the joining face. A concave portion groove 12, a thin wall portion 11, etc. are formed on a pressing face opposed to the joining face.

The strongest force is applied to a joining start point 25 when the first substrate 31 and the second substrate 1 are joined to each other. Accordingly, the joining start point 25 tends to be a start point of deformation of the second substrate 1. The joining start point 25 corresponds to each of both end portions 32 of the first substrate 31. In FIG. 3, reference numeral A designates a length of the second substrate in an arranging direction of the liquid flow path grooves on the joining face. Reference numeral B designates a length of the first substrate 31. Reference numeral C designates an arranging length of discharging ports 18 for discharging a recording liquid (e.g., the length of a liquid discharging functional portion functioning in liquid discharge). It is generally necessary to set the length A to be longer than the length B so as to join the second substrate 1 to the first substrate 31. However, when the length A is set to be too long, both the substrates are easily joined to each other, but a liquid ejecting recording head itself is large-sized. As a result, a liquid ejecting recording head printer is large-sized. In contrast to this, when the length B is conversely set to be short, the liquid ejecting recording head is made compact. However, when the length B is excessively close to the arranging length C of the discharging ports 18, the joining start point 25 approaches the discharging ports 18. Therefore, when the second substrate 1 is deformed, the discharging ports 18 are also deformed by this deformation of the second substrate 1. Thus, a liquid reaching accuracy is shifted only in a printing end portion in the liquid ejecting recording head in which the lengths B and C are close to each other. When such a phenomenon is caused, linearity of one thin straight line is lost in printing even when the reaching accuracy of the recording liquid in the printing end portion lies within a standard accuracy but is separated from an average of the entire reaching accuracy.

Therefore, in this embodiment, the length A of the second substrate in the arranging direction of the liquid flow path groove on the joining face of the second substrate 1 joined to the first substrate 31 is set to be sufficiently longer than the arranging length (the length of the liquid discharging functional portion) C of the discharging ports 18 for discharging the recording liquid. Further, this length A is set to be longer than the length B of the first substrate 31. In such a construction, positions of the discharging ports 18 for discharging the recording liquid can be separated from a position of the joining start point 25 at which an end portion of the first substrate 31, as a portion in which stress is concentrated most strongly in pressing and joining of the second substrate 1 to the first substrate 31, is joined to the second substrate 1. Therefore, if stress is concentrated at the joining start point 25, the discharging ports 18 are sufficiently separated from this concentrated stress portion that no liquid discharge from the discharging ports 18 is influenced by this stress concentration. As a result, when the second substrate 1 and the first substrate 31 are particularly joined to each other by giving a mechanical biasing force, the amount of this biasing force (load) can be increased.

Each of the lengths A, B and C is arbitrarily set and an optimum relation is calculated by sufficiently considering the above matters. Thus, it is confirmed that a relation satisfying a condition of $(A-C)/2 \geqq 1.1$ mm, and $(B-C)/2 \geqq 0.825$ mm is best.

For example, a printing operation is performed by manufacturing the liquid ejecting recording head using the second substrate having the relation of A=14.9 mm, B=14.4 mm and C=11.241 mm. In this case, the linearity of a straight line is excellent in comparison with a liquid ejecting recording head manufactured by using a second substrate having a similar shape and the relation of A=14.9 mm, B=11.4 mm and C=11.241 mm.

(Fourth Embodiment)

Figure 4A:
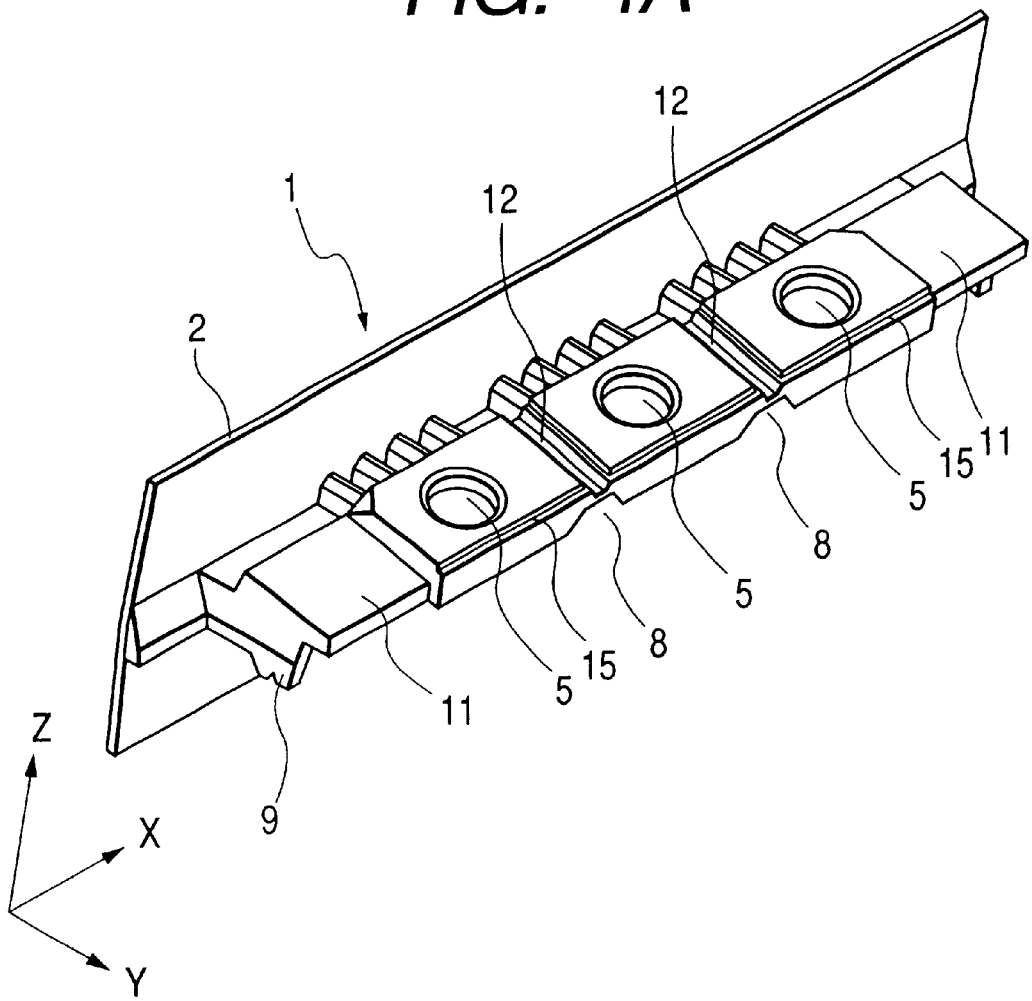
FIG. 4A is a perspective view of a second substrate constituting a liquid ejecting recording head in a fourth embodiment of the present invention.
Figure 4B:
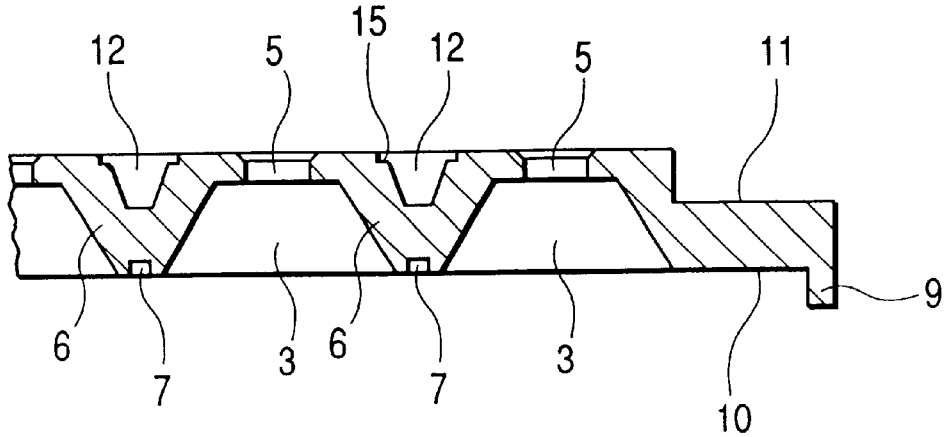
FIG. 4B is a partial sectional view showing this second substrate by partially breaking this second substrate.

FIG. 4A is a perspective view of a second substrate constituting a liquid ejecting recording head in a fourth embodiment of the present invention. FIG. 4B is a partial sectional view showing this second substrate by partially breaking this second substrate. In this embodiment, members and portions similar to those in the above embodiments are also designated by the same reference numerals, and a detailed explanation of these members and portions is omitted here.

In this embodiment, a concave portion groove 12 is formed in a trapezoidal shape, etc. in cross section. The concave portion groove 12 extends entirely along a liquid discharging direction in the position of a pressing face corresponding to a common liquid chamber separating wall 6 for divisionally separating common liquid chambers 3 from each other. Thus, a portion of the common liquid chamber separating wall 6 which is thick in the second substrate 1 can be set to be thin by arranging the concave portion groove 12 in the position of the pressing face corresponding to the common liquid chamber separating wall 6. Further, the second substrate 1 can be entirely formed in a shape softly and easily deformed along the arranging direction of a liquid flow path. Therefore, when the second substrate 1 is pressed and joined to the first substrate 1, the second substrate 1 is easily deformed so that both the substrates can be preferably joined and closely attached to each other.

In this embodiment shown in FIGS. 4A and 4B, the concave portion groove 12 extends entirely in a liquid discharging direction on the pressing face in consideration of the shape of a sealant injecting port 8. However, in the first to third embodiments shown in FIGS. 1A and 1B to 3, the concave portion groove 12 is formed in only one portion of the side of an orifice plate 2 from a relation with the sealant injecting port 8 for injecting a sealant to the common liquid chamber separating groove 7 on the joining face of the second substrate 1. However, similar effects are also obtained by this construction.

In the embodiment shown in FIGS. 4A and 4B, a thin wall portion 11 is formed in each of both end portions of the pressing face as an example. However, the second substrate and the first substrate can be similarly preferably joined and closely attached to each other even when the concave portion groove 12 is simply formed in a position of the pressing face corresponding to the common liquid chamber separating wall 6 without forming this thin wall portion 11.

The shape of the concave portion groove 12 is not limited to the trapezoidal shape in cross section, but may be set to a suitable shape. For example, the concave portion groove can be set to have an inclining face parallel to a wall face of the common liquid chamber separating wall 6. The shape of the concave portion groove 12 is also preferably set to a bilateral symmetrical shape with respect to a central line of this concave portion groove 12. Further, the concave portion groove 12 is easily deformed as a depth of the concave portion groove 12 is increased. Accordingly, it is preferable to suitably set the depth of the concave portion groove 12 in consideration of an entire shape of the second substrate and a shape of the common liquid chamber separating wall 6. Further, a length of the concave portion groove 12 extending in the discharging direction can be also suitably set in consideration of the shapes of the second substrate and the common liquid chamber separating wall 6.

(Fifth Embodiment)

Figure 5A:
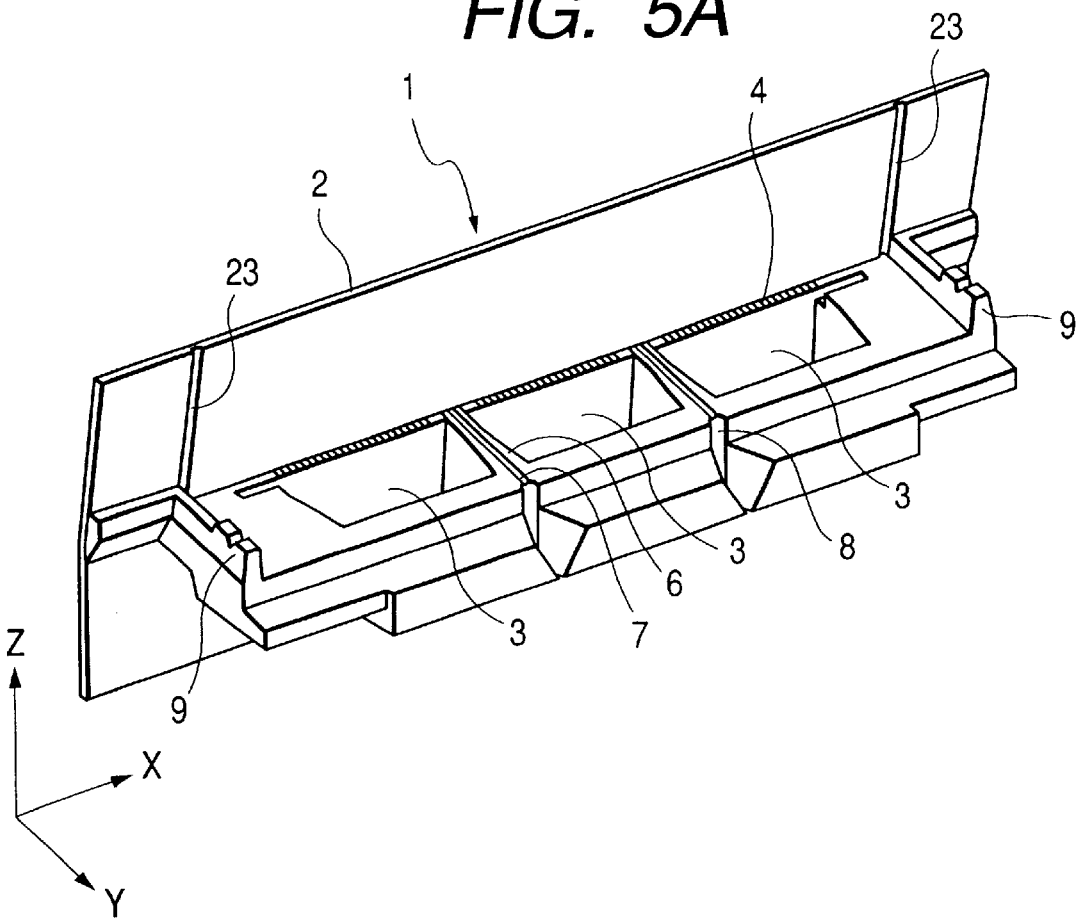
FIG. 5A is a perspective view of a second substrate in a liquid ejecting recording head in a fifth embodiment of the present invention seen from its joining face side.
Figure 5B:
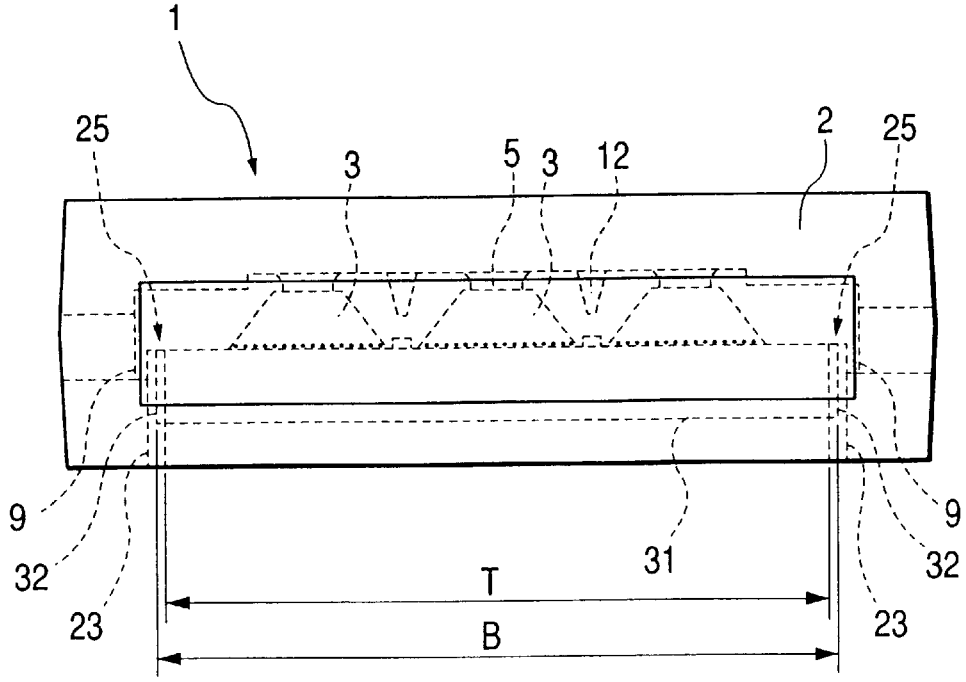
FIG. 5B is a conceptual view seen from a liquid discharging side to show the relation of second and first substrates.

FIG. 5A is a perspective view of a second substrate in a liquid ejecting recording head in a fifth embodiment of the present invention seen from its joining face side. FIG. 5B is a conceptual view seen from a liquid discharging side to show the relation of second and first substrates. In this embodiment, members and portions similar to those in the above embodiments are designated by the same reference numerals, and a detailed explanation of these members and portions is omitted here.

In FIGS. 5A and 5B, reference numeral 23 designates a concave portion dug on a face of an orifice plate 2 on the side of a liquid flow path groove 4. Reference numeral 32 designates an end portion of a first substrate 32. Reference numeral 25 designates a joining start point at which a second substrate 1 comes in contact with the end portion 32 of the first substrate 31 on a joining face of the second substrate 1 joined to the first substrate 31.

In this embodiment, the concave portion 23 is formed in at least one portion of a face joined to the first substrate 31 on a face of the orifice plate 2 on the side of the liquid flow path groove 4. In particular, it is possible to reduce stress concentration caused in joining of the end portion 32 of the first substrate 31 to the second substrate 1 by arranging the concave portion 23 in each of positions corresponding to both the end portions 32, 32 of the first substrate 31.

Therefore, in this embodiment, a concrete size of the concave portion 23 is set to 0.0075 mm in digging-in depth (a Y-direction in FIG. 5A), 0.26 mm in width (an X-direction in FIG. 5A) and 2.45 mm in length (a Z-direction in FIG. 5A). This concave portion 23 is formed in each of positions corresponding to the end portions 32, 32 of the first substrate 31 having a length of 14.4 mm (B). The distance between the concave portions 23 is set to 14.3521 mm and both the end portions 32, 32 of the first substrate 31 are located within the respective concave portions 23. In a construction of such shape, stress concentration caused by joining the first and second substrates can be reduced. Further, the concave portion 23 can restrain deformation of the second substrate 1 since a joining start point 25 (corresponds to a corner portion of each of both the end portions 32 of the first substrate 31) also directly becomes an escape of a portion coming in contact with the second substrate 1. Further, the end portions 32 of the first substrate 31 can be measured without any interference with the second substrate 1.

The second substrate 1 and the first substrate 31 having the above construction are actually joined to each other and are assembled as a liquid ejecting recording head. In this liquid ejecting recording head, deviations in discharging amount and speed are small and the reaching accuracy of a liquid droplet is also preferable in comparison with the liquid ejecting recording head in the above third embodiment. The linearity of a straight line actually printed is also stable. As mentioned above, the digging-in depth of the concave portion 23 is set to 0.0075 mm, but similar effects are also obtained even when the digging-in depth of the concave portion 23 is 0.015 mm. However, when the digging-in depth of the concave portion 23 is excessively increased and its width is excessively widened, a defect is caused on a surface of the orifice plate and a molding property of the second substrate itself is deteriorated. Accordingly, it is desirable to reduce the digging-in depth as much as possible in consideration of a measuring area of the end portion 32 of the first substrate 31.

In this embodiment, the concave portion 23 formed in the orifice plate 2 is arranged such that this concave portion 23 corresponds to the first substrate end portion 32. However, a certain specific reference point (marking) may be formed in the first substrate 31 and a concave portion 23 similar to the above concave portion may be arranged in a position corresponding to a position of this reference point. In this case, this certain specific reference point (marking) of the first substrate 31 is measured over the concave portion 23, and a position of the concave portion 23 and the certain specific reference point of the first substrate 31 are aligned with each other. Thus, the position of the concave portion 23 and the certain specific reference point of the first substrate 31 can be more accurately aligned with each other.

(Sixth Embodiment)

Figure 6A:
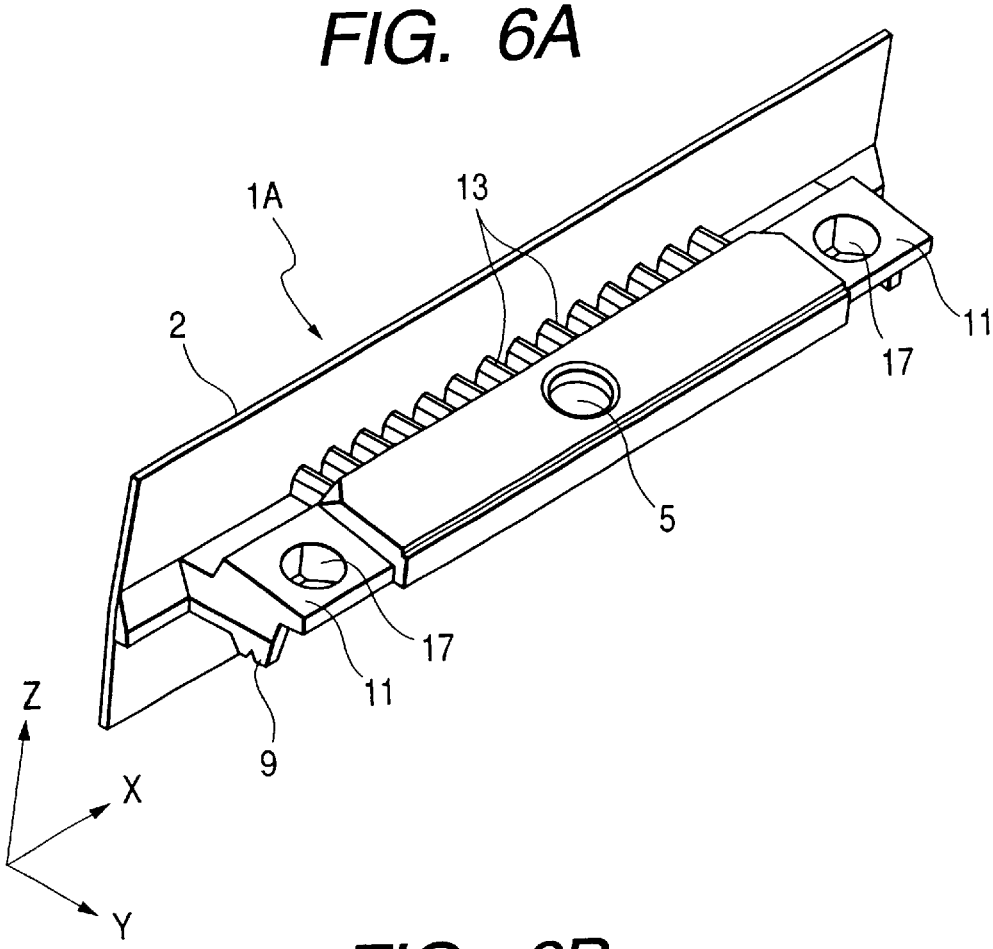
FIG. 6A is a perspective view of a second substrate constituting a liquid ejecting recording head in a sixth embodiment of the present invention.
Figure 6B:
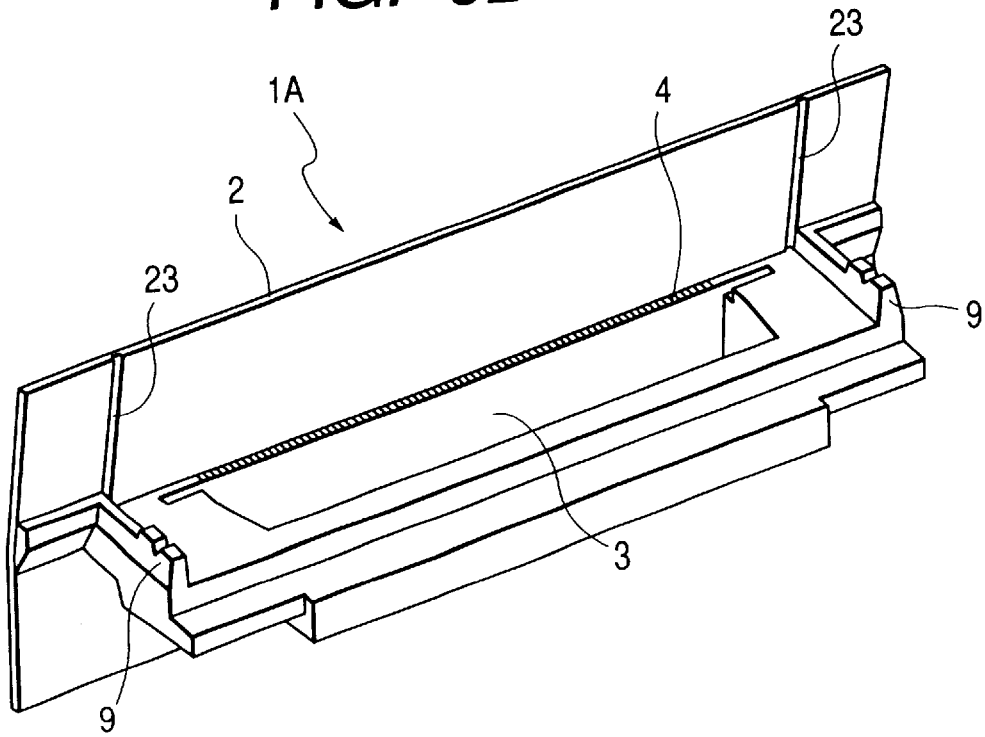
FIG. 6B is a perspective view of this second substrate seen from its joining face side.

In each of the above embodiments, the second substrate 1 having three common liquid chambers 3 is used and is manufactured as a liquid ejecting recording head for color and is evaluated. However, the above embodiments (except for the fourth embodiment in which the concave groove is formed in a position opposed to the common liquid chamber separating wall) are not limited to the liquid ejecting recording head for color. As shown in FIGS. 6A and 6B, similar effects are also obtained even in a liquid ejecting recording head for a monochromatic color, especially black, in which a second substrate 1A having only one common liquid chamber 3 is assembled. It is particularly preferable to adopt the above third embodiment of the liquid ejecting recording head for uses involving black ink where many straight lines are printed and recorded.

What is claimed is:

1. A liquid ejecting recording head comprising:

a first substrate in which a discharging energy generating element for generating discharging energy for discharging a recording liquid is formed;

a second substrate which has a liquid flow path groove which forms a liquid flow path by joining the liquid flow path groove to the first substrate;

a concave portion communicating with the liquid flow path groove and forming a common liquid chamber for temporarily holding the recording liquid; and an orifice plate communicating with said liquid flow path groove and having a discharging port for discharging the recording liquid, wherein the liquid ejecting recording head is constructed by joining said first and second substrates to each other in a manner such that said discharging energy generating element and said liquid flow path groove correspond to each other, and both end portions of a pressed face of said second substrate, opposed to a joining face of said second substrate joined to said first substrate, are formed to be thin.

2. A liquid ejecting recording head according to claim 1, wherein both the thin end portions of a pressed face of said second substrate, opposed to a joining face of said second substrate joined to said first substrate, are arranged with bilateral symmetry with respect to a central line of said second substrate.

3. A liquid ejecting recording head according to claim 1 or 2, wherein digging-in concave portions are formed in both the thin end portions of a pressed face of said second substrate opposed to a joining face of said second substrate joined to said first substrate.

4. A liquid ejecting recording head comprising:

a first substrate in which a discharging energy generating element for generating discharging energy for discharging a recording liquid is formed;

a second substrate which has a liquid flow path groove which forms a liquid flow path by joining the liquid flow path groove to the first substrate;

a concave portion communicating with the liquid flow path groove and forming a common liquid chamber for temporarily holding the recording liquid; and an orifice plate communicating with said liquid flow path groove and having a discharging port for discharging the recording liquid, wherein the liquid ejecting recording head is constructed by joining said first and second substrates to each other in a manner such that said discharging energy generating element and said liquid flow path groove correspond to each other, and digging-in concave portions are formed in both end portions of a pressed face of said second substrate opposed to a joining face of said second substrate joined to said first substrate.

5. A liquid ejecting recording head according to claim 4, wherein said digging-in concave portions are arranged with bilateral symmetry with respect to a central line of said second substrate.

6. A liquid ejecting recording head comprising:

a first substrate in which a discharging energy generating element for generating discharging energy for discharging a recording liquid is formed;

a second substrate which has a liquid flow path groove which forms a liquid flow path by joining the liquid flow path groove to the first substrate;

a concave portion communicating with the liquid flow path groove and forming a common liquid chamber for temporarily holding the recording liquid; and an orifice plate communicating with said liquid flow path groove and having a discharging port for discharging the recording liquid, wherein the liquid ejecting recording head is constructed by joining said first and second substrates to each other in a manner such that said discharging energy generating element and said liquid flow path groove correspond to each other, and a length A of said second substrate in an arranging direction of the liquid flow path groove on a joining face of said second substrate joined to said first substrate is longer than a length B of the first substrate, and is also longer than an arranging length C of the discharging port, and these lengths satisfy the relation of $(A-C)/2 \geqq 1.1$ mm and $(B-C)/2 \geqq 0.825$ mm.

7. A liquid ejecting recording head according to claim 6, wherein both end portions of a pressed face of said second substrate, opposed to a joining face of said second substrate joined to said first substrate, are formed to be thin.

8. A liquid ejecting recording head according to claim 6 or 7, wherein digging-in concave portions are formed in both end portions of a pressed face of said second substrate opposed to a joining face of said second substrate joined to said first substrate.

9. A liquid ejecting recording head according to claim 8, wherein both said thin end portions and/or said digging-in concave portions are arranged with bilateral symmetry with respect to a central line of said second substrate.

10. A liquid ejecting recording head comprising:

a first substrate in which a discharging energy generating element for generating discharging energy for discharging a recording liquid is formed;

a second substrate which has a liquid flow path groove which forms a liquid flow path by joining the liquid flow path groove to the first substrate;

a concave portion communicating with the liquid flow path groove and forming a common liquid chamber for temporarily holding the recording liquid; and an orifice plate communicating with said liquid flow path groove and having a discharging port for discharging the recording liquid, wherein the liquid ejecting recording head is constructed by joining said first and second substrates to each other in a manner such that said discharging energy generating element and said liquid flow path groove correspond to each other, and at least one concave portion is formed on a face of said orifice plate joined to said first substrate.

11. A liquid ejecting recording head according to claim 10, wherein said concave portion formed on the face of said orifice plate is arranged in each of positions corresponding to both end faces of said first substrate.

12. A liquid ejecting recording head according to claim 10 or 11, wherein both end portions of a pressed face of said second substrate, opposed to a joining face of said second substrate joined to said first substrate, are formed to be thin.

13. A liquid ejecting recording head according to claim 12, wherein both said thin end portions and/or said digging-in concave portions are arranged with bilateral symmetry with respect to a central line of said second substrate.

14. A liquid ejecting recording head according to any one of claims 10 or 11, wherein digging-in concave portions are formed in both end portions of a pressed face of said second substrate opposed to a joining face of said second substrate joined to said first substrate.

15. A liquid ejecting recording head according to any one of claims 10 or 11, wherein a length A of said second substrate in an arranging direction of the liquid flow path groove on a joining face of said second substrate joined to said first substrate is longer than a length B of the first substrate, and is also longer than an arranging length C of the discharging port, and these lengths satisfy the relation of $(A-C)/2 \geqq 1.1$ mm and $(B-C)/2 \geqq 0.825$ mm.

16. A liquid ejecting recording head according to any one of claims 5, 6, 7, 10 or 11, wherein said first and second substrates are joined to each other by means of a mechanical biasing force.

17. A liquid ejecting recording head according to any one of claims 1–5, 6, 7, 10 or 11, wherein the concave portion in said second substrate which forms the common liquid chamber by joining the concave portion to said first substrate is separated into plural concave portions by a common liquid chamber separating wall.

18. A liquid ejecting recording head according to claim 17, wherein a concave portion groove extends along a liquid discharging direction, in a portion corresponding to said common liquid chamber separating wall for separating the concave portion forming the common liquid chamber into the plural concave portions, on a pressed face of said second substrate opposed to a joining face of said second substrate joined to said first substrate.

19. A liquid ejecting recording head comprising:

a first substrate in which a discharging energy generating element for generating discharging energy for discharging a recording liquid is formed;

a second substrate which has a liquid flow path groove which forms a liquid flow path by joining the liquid flow path groove to the first substrate;

a concave portion communicating with the liquid flow path groove and forming a common liquid chamber for temporarily holding the recording liquid; and an orifice plate communicating with said liquid flow path groove and having a discharging port for discharging the recording liquid, wherein the liquid ejecting recording head is constructed by joining said first and second substrates to each other in a manner such that said discharging energy generating element and said liquid flow path groove correspond to each other, and the concave portion forming said common liquid chamber is separated into plural concave portions by a common liquid chamber separating wall and a concave portion groove extends along a liquid discharging direction in a portion corresponding to said common liquid chamber separating wall on a pressed face of said second substrate opposed to a joining face of said second substrate joined to said first substrate.

20. A liquid ejecting recording head according to claim 19, wherein said concave portion groove is formed in a bilateral symmetrical shape with respect to a central line of the concave portion groove.

21. A liquid ejecting recording head according to any one of claims 19 or 20, wherein said concave portion groove is formed in a trapezoidal shape in cross section.

* * * * *

UNITED STATES PATENT AND TRADEMARK OFFICE

CERTIFICATE OF CORRECTION

PATENT NO. : 6,361,140 B1
DATED : March 26, 2002
INVENTOR(S) : Shin Ishimatsu et al.

It is certified that error appears in the above-identified patent and that said Letters Patent is hereby corrected as shown below:

Column 15,
Line 52, "claims 5," should read -- claims 1, 2, 4, 5, --.

Column 16,
Line 2, "claims 1-5," should read -- claims 1, 2, 4, 5, --.

Signed and Sealed this

Tenth Day of June, 2003

JAMES E. ROGAN
*Director of the United States Patent and Trademark Office*